US006067997A

United States Patent [19]

Gueret

[11] Patent Number: 6,067,997

[45] Date of Patent: May 30, 2000

[54] APPLICATOR AND PACKAGING AND APPLICATOR UNIT USING SUCH AN APPLICATOR

[75] Inventor: Jean-Louis H. Gueret, Paris, France

[73] Assignee: L'Oreal, Paris, France

[21] Appl. No.: 09/063,411

[22] Filed: Apr. 21, 1998

[30] Foreign Application Priority Data

Apr. 28, 1997 [FR] France ..... 97 05223

[51] Int. Cl.[7] ..... A45D 40/26

[52] U.S. Cl. ..... 132/218; 132/320

[58] Field of Search ..... 132/218, 317, 132/320, 313; 401/126, 129, 128, 130, 122

[56] References Cited

U.S. PATENT DOCUMENTS

| | | | |
|---|---|---|---|
| 565,328 | 8/1896 | Buhler | 401/122 |
| 3,033,213 | 5/1962 | Joss et al. | 401/122 |
| 3,214,782 | 11/1965 | Masters et al. | 401/122 |
| 3,469,928 | 9/1969 | Widegren | 401/122 |
| 3,908,675 | 9/1975 | Spatz et al. | 401/122 |
| 3,908,676 | 9/1975 | Levine et al. | 132/218 |
| 3,921,650 | 11/1975 | Montgomery | 132/218 |
| 4,545,393 | 10/1985 | Gueret et al. | 132/218 |
| 4,662,385 | 5/1987 | Schefer | 132/218 |
| 4,784,505 | 11/1988 | Dahm | 401/122 |
| 4,804,004 | 2/1989 | Taylor | 132/218 |
| 4,810,122 | 3/1989 | Cole | 132/218 |
| 4,887,622 | 12/1989 | Gueret . | |
| 4,898,193 | 2/1990 | Gueret | 132/218 |
| 5,094,254 | 3/1992 | Krueckel et al. . | |
| 5,197,497 | 3/1993 | Gueret | 132/218 |
| 5,224,787 | 7/1993 | Vasas | 132/218 |
| 5,238,011 | 8/1993 | Gueret | 132/320 |
| 5,345,644 | 9/1994 | Gueret | 132/218 |
| 5,357,987 | 10/1994 | Schrepf | 132/218 |
| 5,542,439 | 8/1996 | Gueret | 132/218 |
| 5,722,436 | 3/1998 | Vandromme et al. | 132/218 |

FOREIGN PATENT DOCUMENTS

| | | | |
|---|---|---|---|
| 0 511 842 | 11/1992 | European Pat. Off. . | |
| 2285101 | 4/1976 | France | 401/122 |
| 2 505 633 | 11/1982 | France . | |
| 2678494 | 1/1993 | France | 132/128 |
| 2 730 911 | 8/1996 | France . | |
| 2 745 272 | 8/1997 | France . | |
| 2204166 | 3/1973 | Germany | 132/218 |
| WO 96/29905 | 10/1996 | WIPO . | |

*Primary Examiner*—Todd E. Manahan

*Attorney, Agent, or Firm*—Oblon, Spivak, McClelland, Maier & Neustadt, P.C.

[57] ABSTRACT

An applicator (1) especially for make-up product (P), includes a first applicator region (2) formed by a molded support with an axis X and having a number of reliefs (5) over at least part of its surface. The reliefs are capable of holding the product at their surface, of transporting it and of releasing it to a surface to be treated. The support, together with the reliefs, is formed of a moldable material. A second applicator region (7) is disposed adjacent to the first, and has one end secured to a first end (3) of the first applicator region (2). The second applicator region (7) consists, at least in part, of a material capable of pumping the product from deep down and/or of natural or synthetic fibers.

27 Claims, 4 Drawing Sheets

FIG. 1
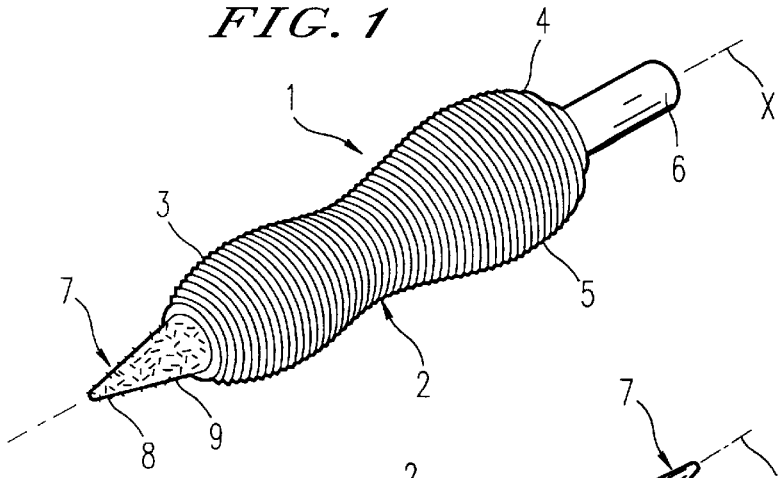
FIG. 2
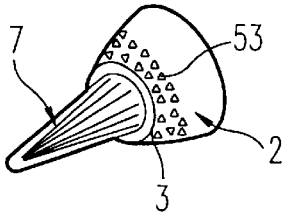
FIG. 3B
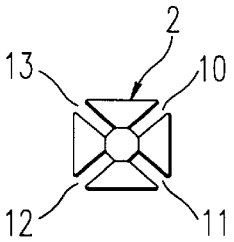
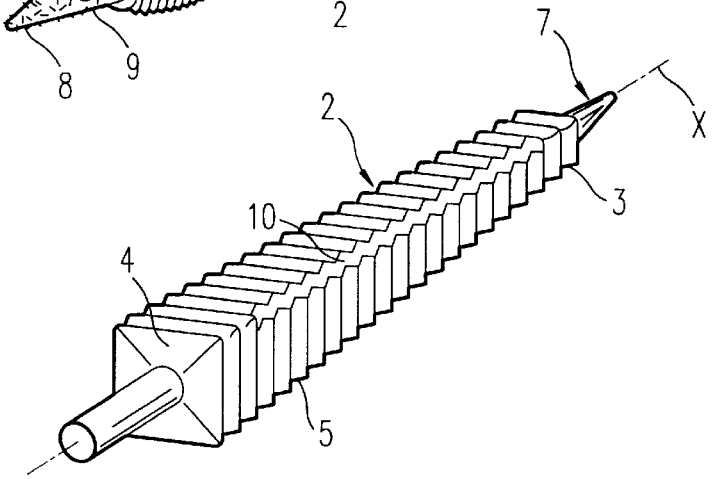
FIG. 3A
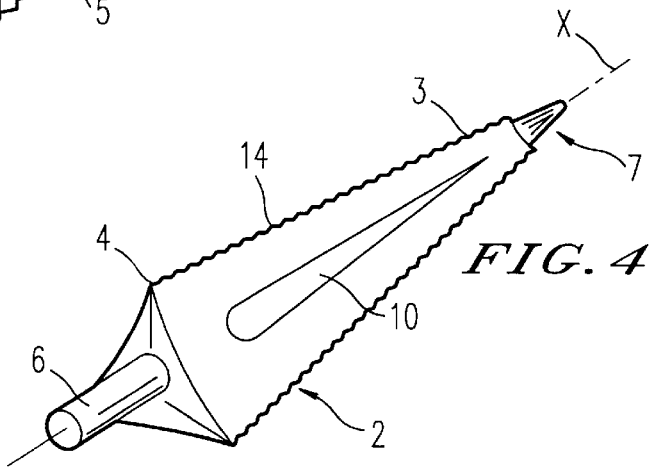
FIG. 4
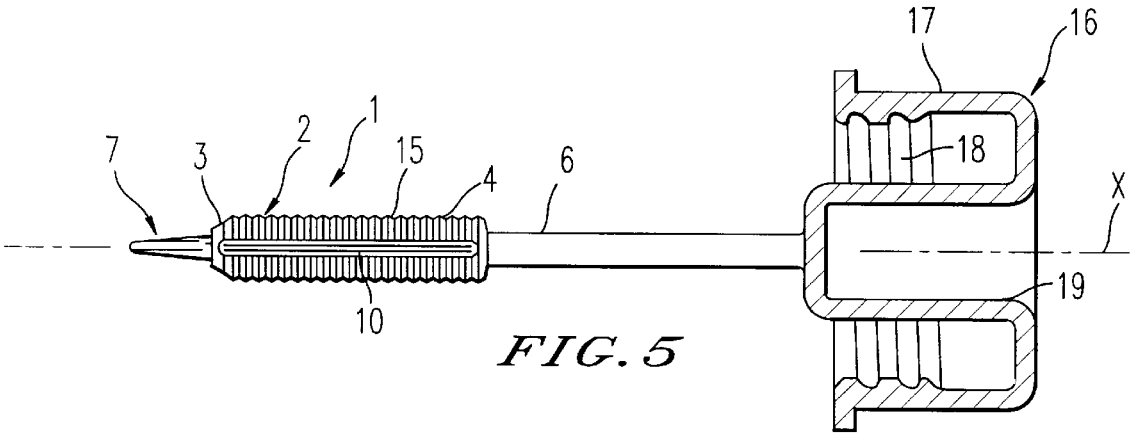
FIG. 5

APPLICATOR AND PACKAGING AND APPLICATOR UNIT USING SUCH AN APPLICATOR

BACKGROUND OF THE INVENTION

1. Field of the Invention

The present invention relates to an applicator, especially for a make-up product, and to a packaging and applicator unit using such an applicator. The invention is particularly suited to products used for making-up the eyelashes, the eyebrows, the eyelids, etc. The invention is aimed particularly at liquid products whose viscosity is such that they can flow under gravity. As a purely illustrative example, mention may be made of multipurpose formulae (mascara-liner among others) based on polymers that can be cross-linked or coagulated (pseudo-latex, silicones), pigments or emollients. Mention may also be made of oils, gels, emulsions, sera, etc.

2. Description of the Related Art

In the field of make-up in particular, it may be desirable to have applicators which have more than one application characteristic and/or allow the same applicator to be used to apply make-up to different surfaces. Thus, for example, in the field of mascaras, it may be desirable to be able to use the same applicator to apply make-up both to the eyelashes and the eyelids, or to the eyebrows and the eyelids, or alternatively to the eyelashes and the eyebrows. Likewise, it may be advantageous to be able to have an applicator which offers two application characteristics for applying make-up to the same surface, for example one for applying the product and the other for finishing, or in the case of a mascara for eyelashes, one for applying the product and the other for separating the lashes after application.

In one of the embodiments of the brush described in U.S. Pat. No. 4,887,622, three to five turns situated near the free end of the brush have more bristles than the others, particularly to allow make-up to be applied to the shorter lashes or the corner of the eye. The application characteristics of this end portion are still, however, similar to the application characteristics of the rest of the brush. Furthermore, applying make-up using an applicator of the type with just bristles has limits which it may, for certain applications, be desirable to surpass. These limits derive essentially from the lack of variety in the possible application characteristics, even though the last few years have seen the arrival of new possibilities in terms of application characteristics with the appearance of brushes with bristles, the number, nature, arrangement and shape of which have changed markedly. The ability to surpass these limits also meets a need for new marketing concepts and allow substantial development of the market in question, particularly using formulae which are more "liquid" than those used in traditional mascaras.

The technique of molding applicators in the form of brushes is known, particularly from French Patent No. 2,505,633. Nonetheless, the applicator is still a brush, with the same limits as those mentioned earlier.

Likewise, it has been proposed that a small block of foam be mounted on the free end of a brush of the twisted brush type. The main function of this block of foam is to prevent the user from injuring herself with the free end of the twisted wire around which the bristles are wound. However, the applicator is still a brush with its limits and drawbacks. Among these drawbacks, not yet mentioned, is the fragility of brushes and the way in which they become damaged quite quickly, particularly after they have passed a few times through the wringing devices, which subject the bristles to substantial amounts of stress.

SUMMARY OF THE INVENTION

Thus, one of the objects of the invention is to produce an applicator that makes it possible, with at least two different applicator regions, to obtain at least two application characteristics, either for applications to the same region to be treated, or for two different regions.

Another object of the invention is to provide a novel design of applicator which is simple, economical to produce and robust, and which meets the new expectations of the existing or potential market.

According to the invention, these and other objects are achieved by producing an applicator especially for make-up product, comprising a first applicator region formed on a support having a number of reliefs over at least part of its surface, the reliefs being capable of holding the product at their surface, of transporting it and of releasing it to a surface to be treated. The support, together with the reliefs, is formed by molding a moldable material. A second applicator region is adjacent to the first and has a portion secured to a first end of the first applicator region, the second applicator region consisting at least in part of a material capable of pumping the product from deep down and/or of natural or synthetic fibers.

Thus, the first applicator region, which preferably represents a substantial part of the axial length of the applicator, holds the product on the surface it defines by capillarity or surface-tension effect, which can be further increased by any chemical or electrochemical treatment, by a corona-effect or by the spraying of a lacquer and fillers, so as to alter its surface finish and make it rougher. The second applicator region consists of a material which, by its nature (fibrous or porous), is capable of retaining the product at the surface, and of deep down pumping (by capillary pumping either from the material itself in the case of a porous material, or between the fibers). This difference regarding the capillarity of the material, one external, the other both internal and external, makes it possible to apply the product present on the first applicator region without the risk of losing the product present on the second applicator region, owing to the fact that it is located deeper inside. This results in an applicator with two applicator regions, which lends itself perfectly to sequential application, without the risk of any appreciable loss or flowing of the product to be applied second. Furthermore, the combination of two applicator regions, the upstream one of which is loaded mainly at the surface, and the downstream one of which is loaded both on the surface and deep in, allows the applicator as a whole to be rung out perfectly, insofar as the second applicator region surprisingly allows any excess product on the first region to be absorbed, and thus improves its wringing.

Advantageously, the first applicator region has an axial length 2 to 10 times, and preferably 3 to 7 times, greater than the axial length of the second applicator region.

As a preference, the second applicator region is axially aligned with the first applicator region. Alternatively, the second applicator region may be inclined with respect to the axis of the support of the first applicator region. For certain applications, this makes it possible to use easier motions in applying the product present on the second applicator region. The angle formed by the second applicator region with respect to the first may be from 20° to 450°, and preferably from 5° to 30°. Alternatively, the applicator may make such an angle with respect to the axis of the wand, the first and second applicator regions being aligned with each other.

The second applicator region may consist of a brush, a twisted brush, a felt tip, a flocked tip, a foam, a flocked foam, a sintered material, etc. As a preference, the second applicator region forms a tip which tapers towards the opposite end to the end near the first applicator region. Other shapes are, however, possible, in particular depending on the surface to be treated.

According to an alternative form of the invention, the first applicator region has a number of longitudinal and/or angular sectors, each having reliefs of different shape and/or size and/or layout, defining different application characteristics. This makes it possible to further increase the number of application characteristics that are possible with such an applicator.

The reliefs may consist of furrows, slots, fingers, diamond points, grooves, striations, lumps, fins, etc. Such reliefs may be of uniform dimensions (depth, width) over the entire surface of the first applicator region, or may have varying dimensions. Typically, the depth of the reliefs may range from 0.1 mm to 3 mm, and preferably from 0.5 mm to 2 mm.

The reliefs may be aligned axially and/or at right angles to the support axis of the first applicator region, or arranged in a staggered configuration. This gives great flexibility in applying the product. In the case of a product to be applied to hairs, such as the eyelashes, the ability to comb, smooth or separate the lashes after application may be varied.

According to a first embodiment, the first applicator region comprises at least two flat, concave or convex faces forming corners, the reliefs being formed of striations formed in each of the corners and oriented at right angles to the support axis of the first applicator region. The shape of the first applicator region is chosen to suit the profile of the surface to which the product is to be applied. By way of example, the first applicator region support may be of cylindrical, conical or frustoconical shape, or in the shape of a rugby ball, a fish, a teardrop, a peanut, etc.

Advantageously, the support of the first applicator region has a second end opposite the first end, the second end being secured to a wand aligned with the applicator axis, and comprising means for holding. The diameter of the wand may be from 0.8 mm to 5 mm, and preferably from 1 mm to 2 mm. As a preference, the wand has a cross-section smaller than the average crosssection of the first applicator region of the applicator. This substantially improves the wringing of the applicator when the latter is extracted from the container containing the product to be applied.

The wand may be molded integrally with the first applicator region. Alternatively, the applicator forms a separate part from the wand, on which it may be mounted by welding, bonding, snap-fitting, force-fitting, etc.

The means for holding may comprise means capable of interacting with complementary means provided close to an opening delimited by a free edge of a container containing the product, so that the opening can be sealed in a leaktight way.

The fibers of the second applicator region may be plant fibers (cotton, rayon, cellulose), animal fibers, organic fibers or fibers made of a thermoplastic material (polyamide, polyester, nylon) and/or elastically deformable material such as elastomers, thermoplastic elastomers, vulcanized elastomers, etc.

The material capable of pumping the product from deep down may consist of a sinter or a foam chosen from polyurethane, polyethylene, polyvinyl chloride, polyether, NBR (natural rubber), SBR (synthetic rubber) foams, etc.

The materials used to form the first applicator region may be thermoplastic materials such as polyethylenes, polypropylenes, polyacetals, polyurethanes, polyvinyl chlorides, polystyrenes, etc. and/or elastomeric materials such as polyethylene, polyurethane, polyester, polyether-block-amide elastomers; polyvinyls; terpoiymers of ethylene, propylene and a diene (EPDM); styrene-butadiene block copolymers (SEBS-SIS); silicone, nitrile, butyl, etc. elastomers, or a mixture of such materials with plant fibers such as cotton or cellulose fibers.

According to a preferred embodiment of the invention, the first applicator region has at least one groove or slot extending axially over almost the entire length of the support. In a particular embodiment, the first applicator region has at least two faces, the grooves or slots being placed either close to the solid angles of intersection separating two contiguous faces or in the middle of the faces. Such grooves may have a depth of from 0.5 mm to 3 mm and a width of from 0.1 mm to 2 mm. Alternatively, the grooves or slots may be arranged at right angles to the axis instead of longitudinally. They may communicate with each other or be isolated from one another.

The second applicator region may be fixed to the first by bonding, welding, force-fitting or snap-fitting, or is obtained by being molded over or into the first applicator region. In a preferred embodiment, the second applicator region at the opposite end to its free end forms an extension which can be inserted into an axial recess made in the support of the first applicator region, it being possible for the recess to be isolated from the surface of the first applicator region. The extension may extend into the recess over all or part of the length of the support. This is particularly advantageous since, without increasing the external volume, it makes it possible to increase the pumping capacity of the second applicator region, especially during wringing, thus making it possible to absorb almost all of the excess product on the first applicator region while keeping the second applicator region free of any excess product. Alternatively, as appropriate, the longitudinal slots open into the axial recess, in which case the extension lying inside the recess serves as a bridge of material for retaining liquid between the edges delimiting the groove. The extension may be of the same nature as the second applicator region, or of a different nature.

According to another aspect of the invention, a unit for packaging and applying a make-up product comprising an applicator according to the invention may comprise a container containing the product and a free edge which delimits an opening, the applicator being borne by a wand whose end opposite the applicator comprises means capable of sealing the opening in a removable way when the applicator is placed inside the container. Wringing means are provided for metering the product on the applicator when the latter is withdrawn from the container with a view to applying some product.

According to a preferred embodiment, the wringing means comprise a block of foam through which a passage or at least one slot passes axially. By way of an illustration, use is made of an elastomer foam such as a polyurethane or polyether foam in particular. Alternatively, the wringing means comprise a member in the shape of a split diabolo, i.e. two cones opposed to each other at their summits. Such a wringing member may be made of an elastically deformable material, such as a thermoplastic elastomer.

BRIEF DESCRIPTION OF THE DRAWINGS

Apart from the provisions explained hereinabove, the invention consists in a certain number of other provisions which will be explained hereinbelow, with regard to non-limiting embodiments described with reference to the appended figures among which:

FIG. 1 illustrates a first embodiment of the applicator according to the invention;

FIG. 2 is a part view of a second embodiment of the applicator according to the invention;

FIGS. 3A and 3B illustrate, in perspective and in section, a third embodiment of the applicator according to the invention;

FIG. 4 illustrates a fourth embodiment of the applicator according to the invention;

FIG. 5 illustrates an applicator according to the invention, mounted on a wand fitted with means allowing it to be mounted on a packaging and applicator unit;

DETAILED DESCRIPTION OF THE PREFERRED EMBODIMENTS

Figure 6:
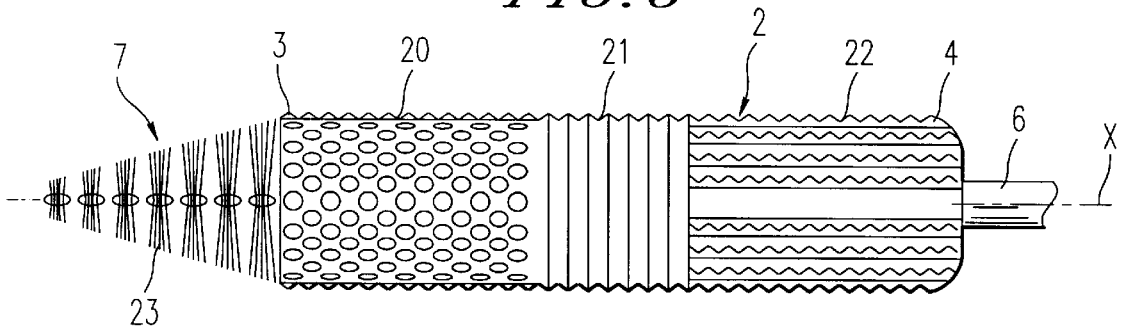
FIG. 6 illustrates a fifth embodiment of the applicator according to the invention.

The applicator 1 shown in FIG. 1 comprises a first applicator region 2 on a support forming most of the applicator and made from a material such as a resin or a thermoplastic powder by molding. This first applicator region 2 delimits a volume, centered on the axis X, of circular cross-section that varies between the first end 3 and the second end 4. The surface of this applicator region has furrows 5 oriented at right angles to the axis X. The furrows may be of identical or varying depth, depending on the nature of the application. Such furrows can retain product at the surface between the tops of the furrows, in particular by surface-tension effect.

The second end 4 of the support of the applicator region 2 is secured to a wand 6 intended, as will be seen, to allow the applicator to be held and mounted on a packaging unit. As a preference, the wand is molded with the support of the applicator region. The diameter of the wand is of the order of 1 mm to 2 mm. The diameter of the applicator region 2 near the ends 3, 4 is of the order of 5 to 7 mm, and is of the order of 3 to 4 mm near the middle. The wand may consist of a material identical to or different from the material forming the molded part.

The unit consisting of the first applicator member 2 and of the wand 6 may be molded in a molding device of the type forming an elongate cavity, determined by a number of mold parts in the form of sectors, which mate along adjacent radial faces when the mold is closed, the sectors moving radially between the closed position and the open position. Such devices are well known in the field of molding and therefore require no further detailed description. The substance may be introduced into the mold by injection, compression or flowing.

The first end 3 is secured to a second applicator region 7 axially aligned with the first applicator region and consists, according to this embodiment, of a flocked tip 8. Such a flocked tip consists of a core, for example made of elastomer, covered with flocking of cotton, rayon or polyamide fibers 9. These fibers define a thin "carpet" capable of pumping products by capillarity. The flocking may contain a mixture of bristles or fibers of different lengths and/or different diameters and/or different natures. The pumping capacity is further improved by making the core of the flocked tip of a sintered, or an open-cell or semi-open-cell cellular, material. The length of the flocked tip may be of the order of 5 mm to 1 cm, and its diameter near the end adjacent to the first applicator region is preferably smaller than or equal to the diameter of the end 3. The flocked tip may be mounted on the applicator by any appropriate means (bonding, welding, snap-fitting, crimping, etc). Thus, such a brush is particularly well suited to making-up the eyelashes using the applicator region 2 then, using the same formula, for drawing a thick or thin line across the eyelid using the end of the flocked tip 8.

In the embodiment of FIG. 2, the furrows are replaced by lumps 53 in the shape of diamond points aligned or arranged in a staggered configuration at the first end 3 of the first applicator region 2. The second applicator region 7 consists of a brush made of a tuft of bristles directed axially. Here too, this array of fibers, made for example of nylon, is capable by capillarity of pumping the product and holding it both on the surface and deep down between the bristles.

In the embodiment of FIGS. 3A and 3B, the first applicator region is of rectangular or square cross-section. The cross-section of this first applicator region 2 decreases between the second end 4 secured to the wand, and the first end 3 secured to the second applicator region 7. Just as in the embodiment of FIG. 1, the surface of the first applicator region has furrows 5 capable of retaining product. In addition, longitudinal grooves 10, 11, 12, 13 are formed in each of the comers of the applicator region 2. These grooves 10, 11, 12, 13, as depicted in the sectional view of FIG. 3B, are arranged so that their respective bottoms converge towards the axis X. The furrows 5 open at their ends into the grooves 10, 11, 12, 13. Such grooves contribute to substantially increasing the surface area for retaining product by surface-tension effect. The depth of the grooves may vary from 0.5 mm to 3 mm.

In this embodiment, the second applicator region 7 consists of a felt tip mounted on the applicator via a sleeve or axial extension borne by the end of the felt tip, which is opposite to its free end and which can be forcibly inserted into an axial housing passing longitudinally through all or part of the first applicator region, the axial housing being isolated from the exterior surface of the first applicator region. The sleeve may also be held in place in the recess by bonding or welding. With a mounting of this kind, the pumping capacity of the felt tip is increased without increasing the external volume of the applicator. This additional pumping capacity makes it possible to substantially improve the autonomy of the second applicator region, and furthermore makes it possible to improve the wringing of the applicator by absorbing any excess product.

In the embodiment of FIG. 4, the first applicator region 2 on the wand 6 is of triangular cross-section, as seen at its second end 4. The faces which delimit it are slightly concave. Just as in the embodiment of FIGS. 3A and 3B, the cross-section of the molded first applicator region 2 decreases gradually towards the second applicator region 7. A longitudinal groove 10 is arranged longitudinally approximately in the middle of each of the faces. Striations 14 are made on each of the solid angles of intersection of the triangle so as to retain product at the surface by a surface-tension effect. The second applicator region 7 here too consists of a brush which tapers from its first end 3 to its free end, and the maximum cross-section of which is preferably smaller than the minimum cross-section of the first applicator region 2.

In the embodiment of FIG. 5, the first applicator region 2 forms a right cylinder of revolution through which at least one groove 10 passes longitudinally. The surface of the first applicator region has striations 15 arranged along its entire length running from the first end 3 to the second end 4, at right angles to the axis X and opening via their ends into the groove or grooves 10. The second applicator region 7 consists of a point made of sintered material. The opposite end of the wand 6 to the applicator 1 has means for holding, also forming a cap 16 for sealing a container containing the product to be applied. Such a cap may be obtained by molding with the wand 6 and the first applicator region 2. The cap 16 comprises a lateral skirt 17, the outer surface of which may be covered with an outer covering (not shown). The internal surface of the lateral skirt has a screw thread 18 capable of interacting with a corresponding screw thread provided on the external surface of the neck of the container. The cap defines an internal skirt 19, a closed end of which carries the wand 6, and the outside diameter of which is designed to seal the opening of the product container in a leaktight way.

The applicator depicted in FIG. 6 can be distinguished from the other embodiments in that the first applicator region 2 defines a number of longitudinal sectors 20, 21, 22 having different reliefs, so as to allow greater flexibility in the application characteristics of the applicator. Thus, a first sector 20 has lumps in the shape of diamond points arranged in a staggered configuration. A central sector 21 has furrows at right angles to the axis X. A third sector has rows of sawtooth reliefs oriented parallel to the axis X. The second applicator region 7 consists of a twisted brush 23, the maximum diameter of which is at most equal to the diameter of the first applicator region, and which is configured towards a point at its free end. The twisted brush 23 is made in a conventional way using a rigid or semi rigid wire bent into a hairpin shape, which is twisted on itself after fibers, for example made of nylon, have been arranged appropriately between the two branches of bent wire. This applicator region in the form of a twisted brush may advantageously be used for separating the eyelashes following application using the molded first applicator region 2 or for applying make-up to the corner of the eye, or any other surface which is difficult to access. The brush 23 may be mounted on the first end 3 of the first applicator region by forcible insertion into an axial housing formed in the support of the first applicator region 2, of an unbristled end of the core of the brush.

Figure 7A:
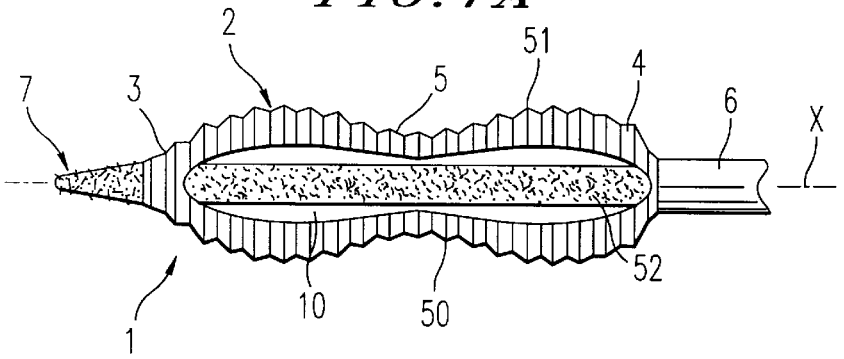
FIGS. 7A–7B and 8A–8B illustrate yet more alternative forms of the applicator according to the invention.
Figure 7B:
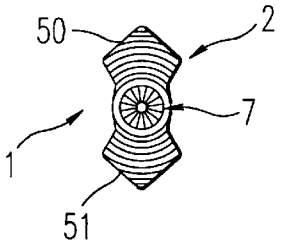

FIGS. 7A–7B illustrate another embodiment of the applicator 1 according to the invention. In this embodiment, the first applicator region 2 has an elongate cross-section, generally flat, so as to define two main faces through which there passes a slot or slit 10 extending axially over almost the entire length of the molded part and delimited mainly by two longitudinal surfaces 50, 51. The first end 3 of the molded part which is opposite the wand 6 has an axial orifice in which a flocked felt tip is forcibly mounted at the second end 4. The felt tip is long enough to extend axially inside the slot 10 over approximately the entire length of the molded part, and its tip emerges beyond the molded part. This emerging part forms the second applicator region 7 adjacent to the first end 3. An interior part 52 of the felt tip which lies inside the molded first applicator region 2 acts as a bridge of material between the edges of the molded part delimiting the slot 10 so as to produce at least one liquid bridge between the surfaces 50, 51. Note that the part 52, because it is set back slightly from the edges of surfaces 50, 51 of the molded part, does not appreciably come into contact with the surface to be treated, and acts merely as a support for the liquid held at the surface by the first applicator region. Just as was the case for the embodiments of FIGS. 1 and 3A, furrows 5 are formed on the outer surface of the first applicator region, so as to hold product at the surface by surface-tension effect. A front view of the device of FIG. 7A is shown in FIG. 7B.

Figure 8A:
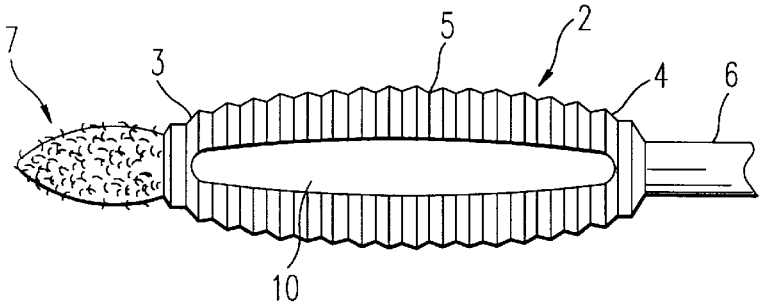
Figure 8B:
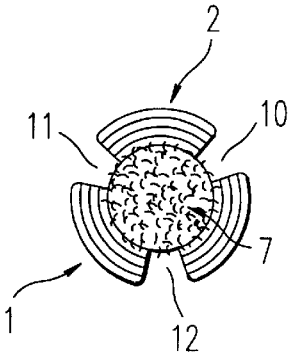

In the embodiment of the applicator 1 shown in FIGS. 8A and 8B, the molded first applicator region 2 is of approximately circular cross-section and has three slots 10, 11, 12 spaced angularly by 120° and communicating with each other at the wand 6. The outer surface generated by this molded part has furrows 5 at right angles to the wand 6 for holding product at the surface. The width of the slots is of the order of 1 to 2 mm. Lengthwise, the slots extend over almost the entire axial length of the applicator region 2, without emerging at the ends 3, 4. A block of flocked foam forming the second applicator region 7 is fixed, by bonding, in line with the wand 6, onto the first end 3 of the first applicator region. Such a block of foam, of teardrop shape, is particularly well suited to applying make-up to the eyelids. A front view of the applicator of FIG. 8A is shown in FIG. 8B. Just as was the case in the previous embodiment, bridges of material may be produced by molding inside the slots 10, 11, 12, so as to produce liquid bridges.

Figure 9:
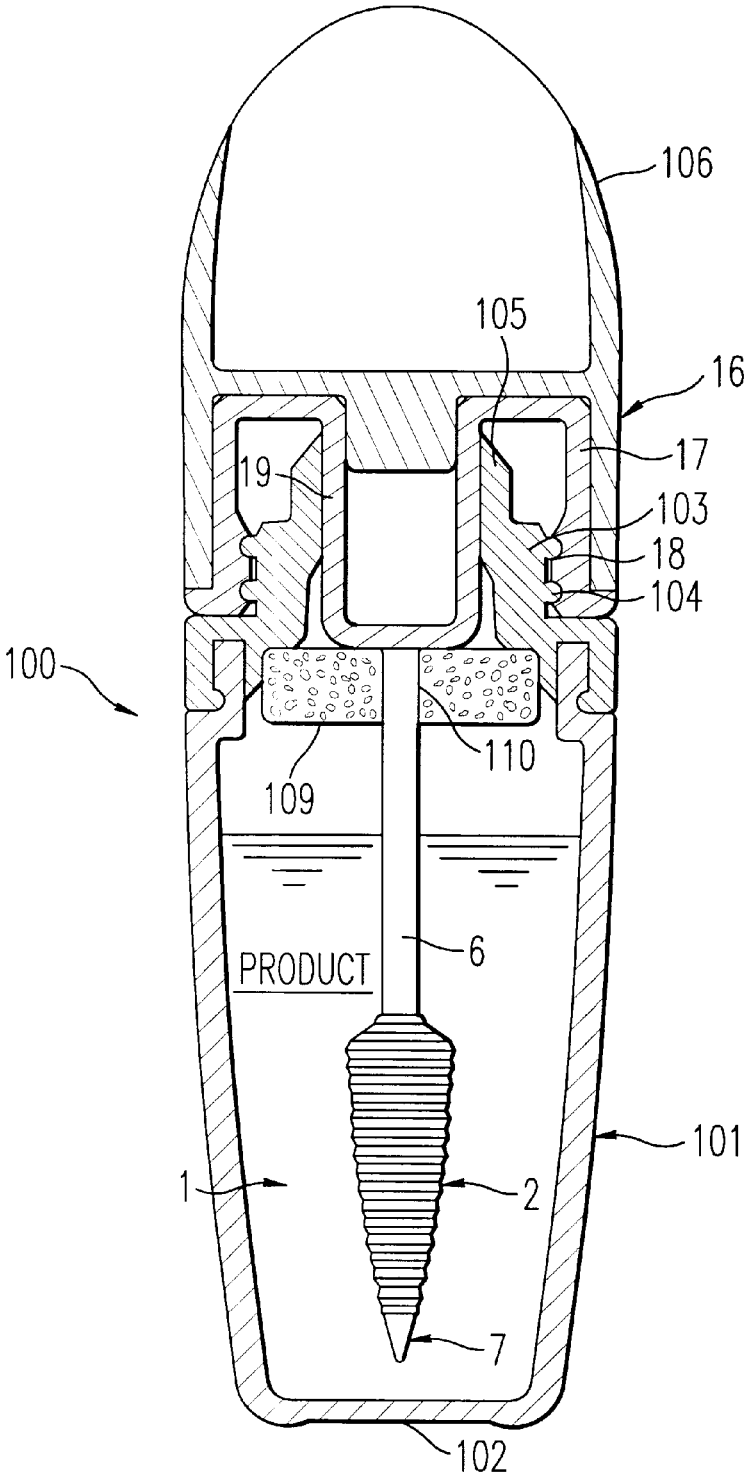
FIG. 9 illustrates one embodiment of a packaging and applicator unit according to the invention.

FIG. 9 illustrates an embodiment of a packaging and applicator unit using a brush like the one described with reference to FIGS. 1 to 6. This unit 100 comprises a container 101, one end of which is closed by a bottom 102, and the other end of which is surmounted by a neck 103 in the form of an attached part snapped onto a free edge of the container 101. The outer surface of the neck 103 has a screw thread 104 capable of interacting with the screw thread 18 borne by the internal surface of the lateral skirt 17 formed by the cap 16 secured to the wand 6. The internal skirt 19 of the cap has an outside diameter designed to close the an opening 105 delimited by the free end of the neck 103 in a sealed manner. An outer covering 106 is placed around the cap. Inside the neck, near its lower end, there is mounted, by bonding or welding, a block of open-cell or semi-open-cell foam forming a wringing member 109. The block of foam has a passage 110 (of a diameter smaller than the outside diameter of the wand 6), or two slots arranged in a cross passing axially through it. Such a wringing member is described in greater detail in French Patent Application Serial No. 96-02477 filed on Feb. 28, 1996 in the name of the applicant company. Alternatively, the wringing member 109 is in the form of a split diabolo, described in greater detail in French Patent No. 2,730,911. When the cap 16 is closed, the applicator 1 has its second applicator region near the bottom 102 of the container 101 and is soaked in the product P, the wand 6 passing through the passage 110 in the wringing member 109.

To use the applicator, the user unscrews the cap 16 and extracts the applicator. During this extraction movement, the wand 6 is wiped by the member 109, as is the applicator 1. In actual fact, during the passage through the wringing member 109, the wringing member 109 holds back any excess product on the first applicator region 2. Only the product contained in the hollow parts of the reliefs it bears remains on the applicator region 2. The second applicator region 7 is also wrung out as it passes through the block of foam, which means that the tip it defines is perfectly tapered, and does not have an excess blob of product at its free end. Any excess product that may remain on the molded part of the applicator flows out onto the second applicator region where it is absorbed. Wringing is perfectly uniform along the entire length of the applicator, which means identical quality for both applicator regions. The applicator, perfectly laden and wrung, is thus ready to be used. Even when the second applicator region is a twisted brush, as discussed with reference to FIG. 6, the bristles it has are not damaged especially since its maximum cross-section is preferably smaller than the minimum cross-section of the molded first applicator region 2.

Figure 10:
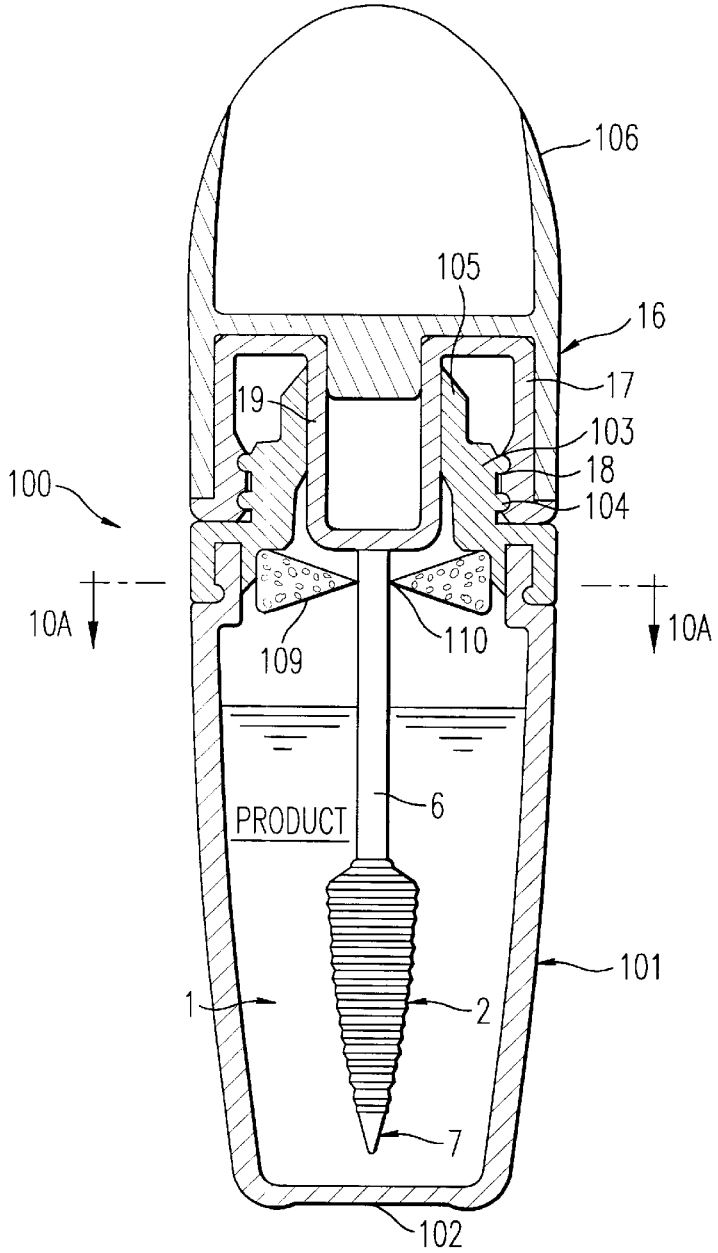
FIG. 10 illustrates another embodiment of the packaging and applicator unit according to the invention.
Figure 10A:
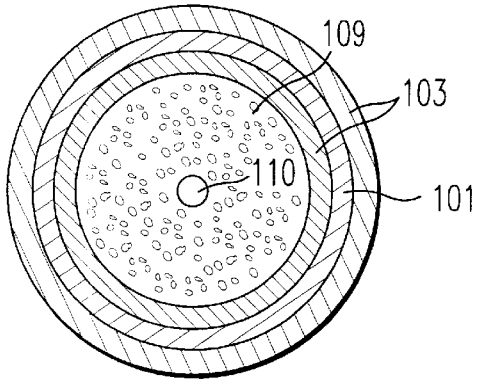
FIG. 10A is a cross-sectional view taken along line 10A—10A in FIG. 10.

FIG. 10 illustrates another embodiment of the packaging and applicator unit, which is the same as the embodiment shown in FIG. 9, except that the wringing member 109 has the cross-sectional shape of a diabolo, i.e., two triangles opposed to each other at their summits. Another view of the wringing member 109 is seen in FIG. 10A taken along line 10A—10A in FIG. 10.

In the foregoing detailed description, reference was made to preferred embodiments of the invention. It is obvious that variations may be made without departing from the spirit of the invention as claimed hereinafter. By way of example, the applicator, particularly the molded first applicator region 2, may be of a curved shape in order further to improve the making-up accuracy.

What is claimed is:

1. An applicator for a fluid product, comprising:

a support having axial ends and defining a first applicator region including at least a portion having a plurality of reliefs over at least part of a surface thereof, the reliefs being configured so as to be able to hold the product essentially at surfaces of the reliefs, to transport the product and to release the product to a surface to be treated;

a second applicator region adjacent to the support and having a portion secured to a first axial end of the support, said second applicator region being formed with at least one of a material capable of pumping the product and fibers, so as to be capable of holding the product both on the surface and in depth;

said first applicator region being upstream and loaded mainly at its surface and said second applicator region being downstream and loaded both on its surface and in depth.

2. The applicator according to claim 1, wherein the second applicator region is aligned with the first applicator region along a common longitudinal axis.

3. The applicator according to claim 1, wherein the second applicator region is inclined with respect to a longitudinal axis of the first applicator region.

4. The applicator according to claim 1, wherein the first applicator region has at least one groove or slot extending axially over almost the entire length of said first applicator region.

5. The applicator according to claim 1, wherein the second applicator region is comprised of one of a brush, a twisted brush, a felt tip, a flocked tip, foam, a flocked foam and a sintered material.

6. The applicator according to claim 1, wherein the second applicator region forms a tip which is tapered to be smaller in a direction extending away from the first applicator region.

7. The applicator according to claim 1, wherein an axial length of the first applicator region is twice to ten times an axial length of the second applicator region.

8. The applicator according to claim 1, wherein the material capable of pumping the product is one of a sintered material and a foam chosen from polyurethane, polyethylene, polyvinyl chloride, polyether, natural rubber and synthetic rubber.

9. The applicator according to claim 1, wherein the reliefs include at least one of slots, furrows, fingers, diamond points, grooves, striations, lumps and fins.

10. The applicator according to claim 1, wherein the reliefs are aligned axially.

11. The applicator according to claim 1, wherein the first applicator region has a shape which is one of cylindrical, conical and frustoconical.

12. The applicator according to claim 1, wherein the reliefs in at least one plural sector are aligned at right angles to a longitudinal axis of the first applicator region.

13. The applicator according to claim 1, wherein the fibers of the second applicator region include one of plant fibers, animal fibers, organic fibers, fibers made of a thermoplastic material, elastomers, thermoplastic elastomers and vulcanized elastomers.

14. An applicator for a fluid product, comprising:

a first applicator region having axial ends and including a plurality of reliefs over at least part of a surface thereof, said reliefs being configured so as to be able to hold the product at the reliefs, to transport the product and to release the product to a surface to be treated, said first applicator region having plural sectors, each of the sectors having said reliefs of different characteristics; and a second applicator region secured to a first axial end of the first applicator region, said second applicator region being formed with at least one of fibers and a material capable of pumping the product.

15. The applicator according to claim 14, wherein the reliefs in at least one of the plural sectors are arranged in a staggered configuration.

16. An applicator for a fluid product, comprising:

a first applicator region having axial ends and including a plurality of reliefs over at least part of a surface thereof, said reliefs being configured so as to be able to hold the product of the reliefs, to transport the product, and to release the product to a surface to be treated;

wherein the first applicator region has at least one groove or slot extending axially over almost the entire length of said first applicator region;

wherein the first applicator region has at least two faces, the groove or slot being placed close to solid angles of intersection separating two contiguous ones of said faces; and a second applicator region secured to a first axial end of the first applicator region, said second applicator region being formed with at least one of fibers and a material capable of pumping the product.

17. The applicator according to claim 16, wherein the second applicator region is inclined with respect to the longitudinal axis of the first applicator region at an angle of from 2° to 45°.

18. The applicator according to claim 16, wherein faces meet at corners, and wherein the reliefs are striations formed in the corners and oriented at right angles to a longitudinal axis of the first applicator region.

19. The applicator according to claim 16, wherein a wand is attached to a second axial end of the first applicator region.

20. The applicator according to claim 1, wherein the first and second applicator regions make an angle of from 2° to 45° with respect to a longitudinal axis of the wand, said first and second applicator regions being axially aligned with each other.

21. The applicator according to claim 20, wherein at least one portion of the wand has a cross-section smaller than an average cross-section of the first applicator region near the second axial end.

22. The applicator according to claim 1, wherein the wand is molded integrally with the first applicator region.

23. The applicator according to claim 16, wherein the first applicator region is formed of at least one of polyethylenes, polypropylenes, polyacetals, polyurethanes, polyvinyl chlorides, polystyrenes, polyethylenes, polyurethanes, polyesters, polyether-block-amide elastomers, polyvinyls, terpolymers of ethylene, propylenes, a diene, styrene-butadiene block copolymers, silicones, nitrile or butyl elastomers, and plant fibers.

24. The applicator according to claim 16, wherein the second applicator region is fixed to the first applicator region by one of bonding, welding, force-fitting, snap-fitting and molding.

25. The applicator according to claim 16, wherein the second applicator region includes a tip insertable into a first end of the first applicator region.

26. The applicator according to claim 16, wherein the grooves have a depth of from 0.5 mm to 3 mm, and a width of from 0.1 mm to 2 mm.

27. The applicator according to claim 16, wherein the groove or slot is placed in the middle of the faces.

* * * * *

UNITED STATES PATENT AND TRADEMARK OFFICE

CERTIFICATE OF CORRECTION

PATENT NO. : 6,067,997

DATED : May 30, 2000

INVENTOR(S): Jean-Louis H. Gueret

It is certified that an error appears in the above-identified patent and that said Letters Patent is hereby corrected as shown below:

Col. 2., line 61, change "20° to 450°" to --2° to 45°--.

Col. 11, line 10, change "polyethylenes, polyurethanes," to --polyethylene, polyurethane--.

Signed and Sealed this

Twenty-second Day of May, 2001

*Attest:*

Nicholas P. Godici

NICHOLAS P. GODICI

*Attesting Officer*

*Acting Director of the United States Patent and Trademark Office*